US008060946B2

(12) United States Patent
Voravan et al.

(10) Patent No.: US 8,060,946 B2
(45) Date of Patent: Nov. 22, 2011

(54) SPORT GLOVE CLOSURE FLAP

(75) Inventors: M Poramats Voravan, North Prakanong Wattana (TH); Kenneth S. Litke, Marion, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 12/928,858

(22) Filed: Dec. 20, 2010

(65) Prior Publication Data

US 2011/0185473 A1 Aug. 4, 2011

Related U.S. Application Data

(63) Continuation-in-part of application No. 12/697,338, filed on Feb. 1, 2010.

(51) Int. Cl.
*A41D 19/00* (2006.01)

(52) U.S. Cl. .. 2/161.1; 24/68 SK; 24/593.1; 24/DIG. 48

(58) Field of Classification Search ..... 2/160, 161.1, 2/161.2, 162, 170; 24/68 SK, 593.1, 593.11, 24/DIG. 48

See application file for complete search history.

(56) References Cited

U.S. PATENT DOCUMENTS

| | | | | |
|---|---|---|---|---|
| 1,083,795 | A | 6/1914 | Brokaw | |
| 2,322,687 | A * | 6/1943 | Gillian | 24/68 R |
| 4,040,126 | A | 8/1977 | Cecil | |
| 4,042,977 | A | 8/1977 | Antonious | |
| 4,658,445 | A | 4/1987 | Tibble | |
| 4,701,963 | A | 10/1987 | Overton | |
| 5,195,188 | A | 3/1993 | Bourdeau et al. | |
| 5,263,202 | A | 11/1993 | Holland et al. | |
| 5,647,104 | A | 7/1997 | James | |
| 5,704,065 | A | 1/1998 | Feuerhake | |
| 5,740,055 | A | 4/1998 | Renegar | |
| 6,052,828 | A | 4/2000 | Widdemer | |
| 6,286,148 | B1 | 9/2001 | Meyer | |
| 6,505,350 | B2 * | 1/2003 | Litke | 2/161.4 |
| 7,480,944 | B2 | 1/2009 | Nascimento | |
| 7,707,695 | B2 * | 5/2010 | Dubois | 24/68 B |
| 2010/0175163 | A1 * | 7/2010 | Litke | 2/161.4 |

* cited by examiner

*Primary Examiner* — Katherine Moran
(74) *Attorney, Agent, or Firm* — D. Michael Burns

(57) ABSTRACT

A glove closure system having an opening dividing the glove into a lateral side (thumb) and a medial side (pinky). The opening allows for easy access of the user's hand. The system consists of a rectangular or oval flap attached to the lateral portion and pulled over the access opening. A primary fit is caused by the user pulling the flap over to the back of the lateral side of the glove and fastening with a hook and loop attachment method.

9 Claims, 4 Drawing Sheets

SPORT GLOVE CLOSURE FLAP

CROSS-REFERENCE TO RELATED APPLICATIONS

The present invention is a continuation-in-part of co-pending U.S. application Ser. No. 12/697,338, filed on Feb. 1, 2010, the disclosure of which is incorporated herein in its entirety.

FIELD OF THE INVENTION

The present invention relates generally to sport gloves, and more specifically, to golf gloves with an adjustable closure system that adjusts by rotation of a ratchet controlled button.

BACKGROUND OF THE INVENTION

With respect to athletic gloves, such as those used in golf, it is important that a glove fit properly and be firmly secured about the wearer's hand to ensure that the glove does not interfere with the feel of a sports instrument in the wearer's hand. While adequate sizing plays a role in ensuring proper fit, a glove must also initially be loose enough to allow the wearer's hand ingress and egress. Thus, to ensure proper fit, there must be a way to tighten the glove after it has been placed over the wearer's hand.

There currently exist a number of mechanisms and methods for tightening gloves around a wearer's hand. Such mechanisms include buckles, straps, buttons, ties, elastic, pull closures, hook and loop systems, cable systems and others. While these mechanisms allow gloves to be tightened, they generally have limited range, are difficult to adjust and operate one-handed, and/or have durability constraints. Buckles or straps, such as those disclosed in U.S. Pat. No. 4,042,977 for example, can be difficult to operate one-handed, as is often required when tightening a glove on to the wearer's other hand. Buttons, such as that in U.S. Pat. No. 1,083,795, are not only difficult to operate one-handed, but also are limited in the range of tightening that they can accomplish. Elastic portions, such as those discussed in U.S. Pat. No. 7,480,944, allow gloves to stretch to allow ingress and egress and then contract to hold the glove in place, and are easy to operate one-handed. However, they can stretch over time, such that they do not maintain a tight fit, and are limited in their ability to create tension around the wearer's hand for a truly snug fit. Pull closures, such as that disclosed in U.S. Pat. No. 5,263,202, allow an elastic strap to be pulled tight, but generally leave excess elastic cord hanging free, which is undesirable in an athletic glove. Lastly, hook and loop closures, often marketed as Velcro®, such as that disclosed in U.S. Pat. No. 4,701,963, can become clogged with other fibers or dirt, and can be difficult to pull tight with a single hand. Cable systems, such as that disclosed in U.S. Pat. No. 5,647,104, can be difficult to operate one-handed in the same manner as hook and loop closures.

Accordingly, there is a need for an improved glove fastening and tightening system.

SUMMARY OF THE INVENTION

The present invention is directed to a glove closure system having an access opening dividing the glove into a lateral side (thumb) and a medial side (pinky finger). The opening allows for easy access of the user's hand. The system consists of a rectangular or oval flap attached to the medial portion by a row of marginal stitching and pulled over the access opening wherein it is attached by hook and loop fastening means. A ratchet-button, allows for a further tightening or loosening of the glove by the user merely rotating the button in a clockwise or counter clockwise direction.

The closure flap includes a bottom piece, a top piece and a slide tab that is sandwiched between them and snap-fitted together into a unitary part. The ratchet-button is integral with the flap by connection to the slide tab with a cog wheel that has teeth meshed within notches defined in the slide tab. When the ratchet-button is turned the slide tab moves in and out to either tighten or loosen the glove.

BRIEF DESCRIPTION OF THE DRAWINGS

In the accompanying drawings, which form a part of the specification and are to be read in conjunction therewith and in which like reference numerals are used to indicate like parts in the following views.

DETAILED DESCRIPTION OF THE INVENTION

The present invention is directed to a glove tightening device and it is to be appreciated that the inventive aspect could apply to many athletic gloves such as a baseball batting glove, racquetball, handball etc. Most golf gloves of today utilize a fastening system wherein a flap is attached on the medial side of the glove (pinkie finger) and the flap is pulled over to the lateral side of the glove (thumb) and attached by means of a conventional hook and loop fastening device (such as Velcro®). The present invention improves on this method by providing a further level in the tightening procedure. It consists in the utilization of a ratchet-button engaged with a slide tab wherein the tab slides in or out of locking positions by rotating the button which results in the tightening or loosening of the glove. This allows for a greater degree of snugness in the glove fit.

Figure 1:
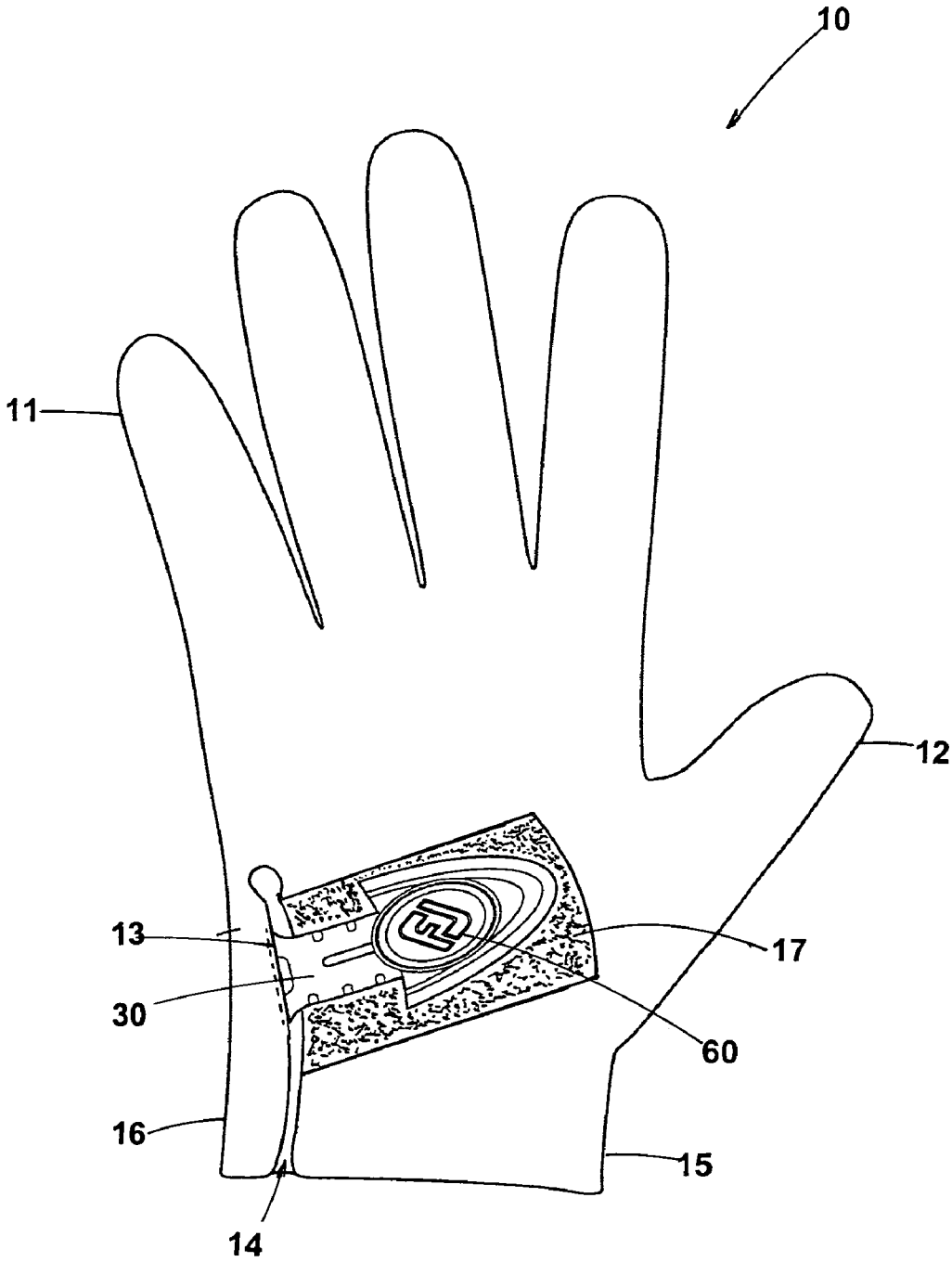
FIG. 1 is a back view of an embodiment of an inventive golf glove closing device incorporating a rotating ratchet button incorporating a sliding tab.
Figure 2:
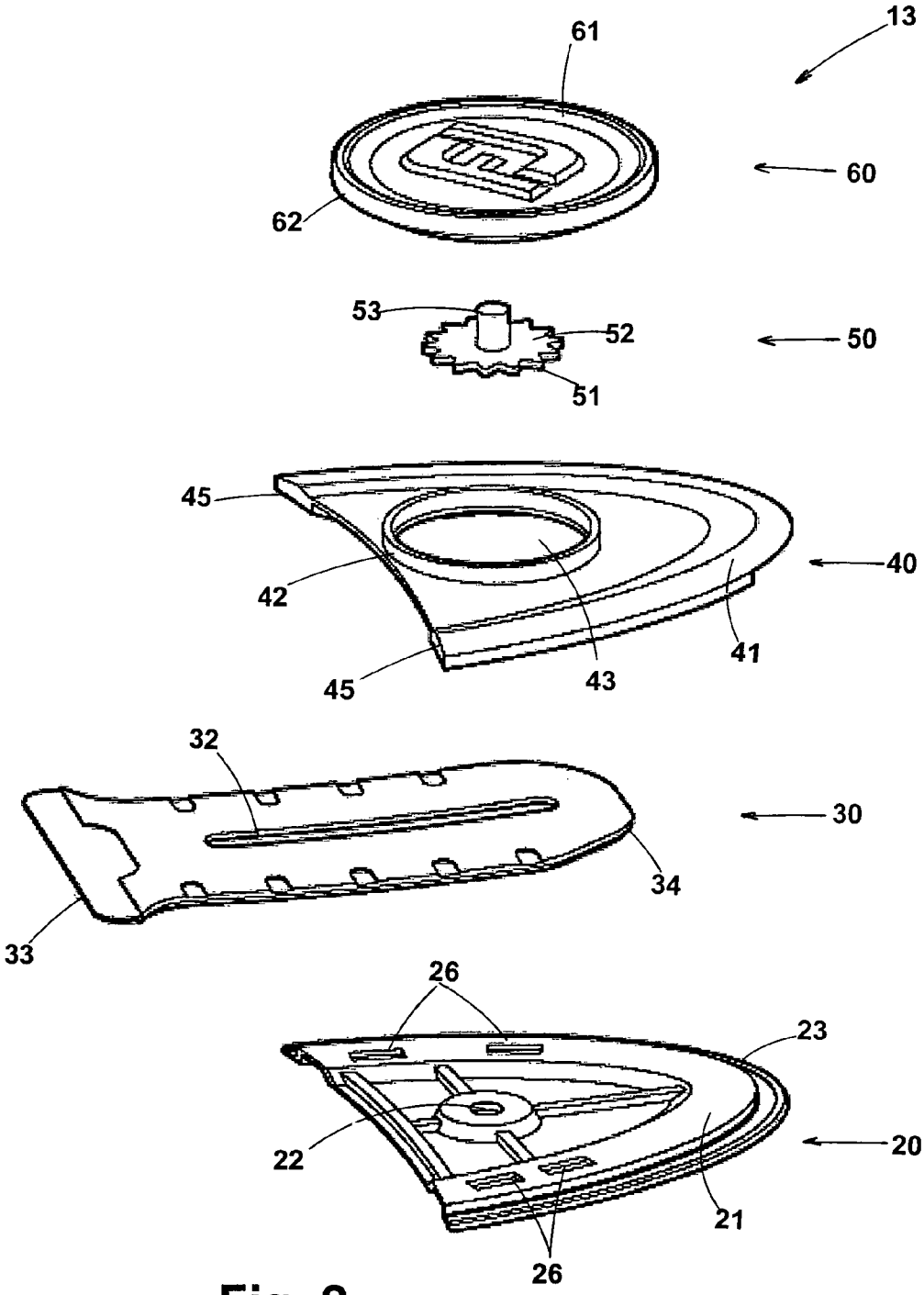
FIG. 2 is an expanded top view of an embodiment of the inventive golf glove closing device incorporating a closure button which may be rotated to tighten the glove.
Figure 3:
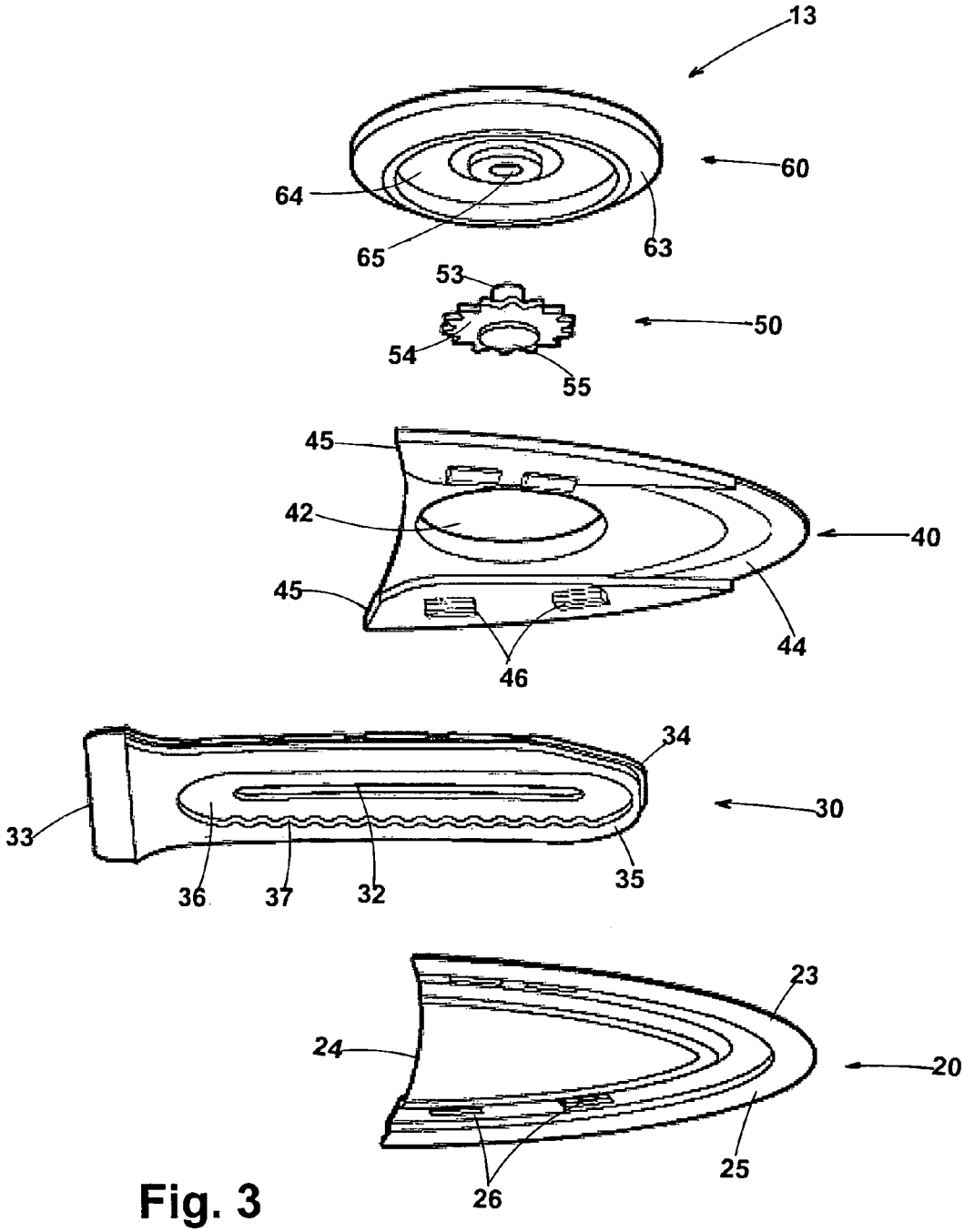
FIG. 3 is an expanded bottom view of the embodiment of shown in FIG. 2.
Figure 4:
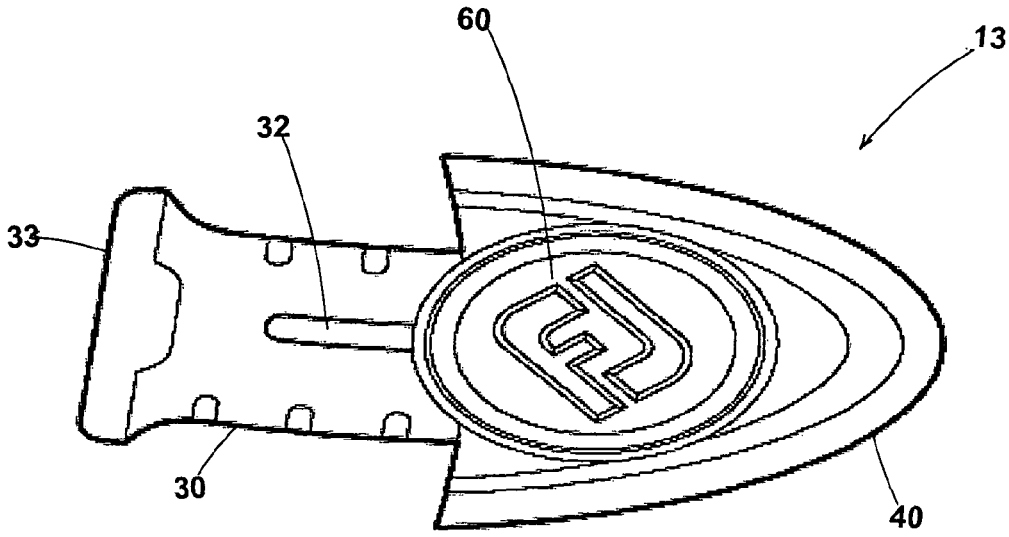
FIG. 4 is a perspective top view of the device of FIG. 1.
Figure 5:
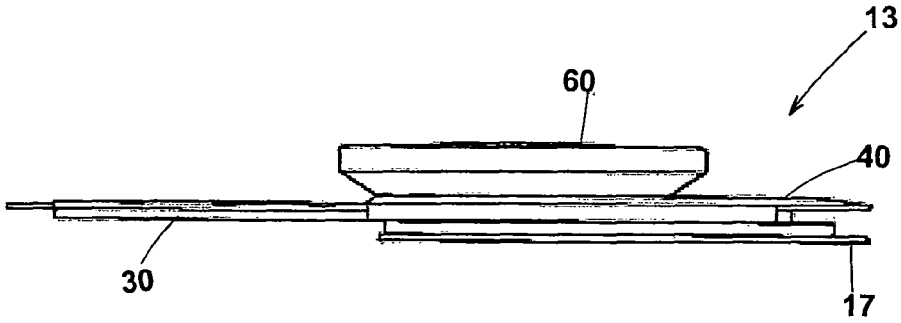
FIG. 5 is an elevated side view of the device of FIG. 1.

FIGS. 1 to 5 depict the inventive golf glove 10 of the type worn by golfers to ensure a firm grip on a club. Like conventional sport gloves, glove 10 includes fingers 11 and a thumb 12, and a novel closure flap 13 for closing and tightening of the glove which comprises a ratchet-button 60 engaging a sliding tab 30 for a further defined tightening as discussed below.

In more detail, glove 10 is of flexible construction, preferably comprising leather, or synthetic leather including but not limited to polyurethane leather (e.g., polyurethane coated nylon), or non-woven material, and can be perforated with ventilation holes on the back surface of the fingers. The glove body includes a front surface (not shown), and a dorsal, back surface which is divided by an access opening 14 into a lateral side 15 (thumb) and a medial side 16 (pinkie). The flap 13 brings the sides 15, 16 together by hook and loop fastening means 17.

FIGS. 1-5 illustrate a glove closure flap 13 in a relatively closed position. Glove closure flap 13 includes a generally semi-oval bottom piece 20, which has a hook and loop fastening means (not shown) attachable to the bottom surface 25 and allows the flap 13 to be attached to a suitable hook and loop (Velcro® type) fastening system 17 on the back surface of the glove. The flap 13 is preferably made of leather material, and includes a sliding tab 30 sandwiched between a generally semi-oval top piece 40 and a corresponding bottom piece 20. The sliding tab 30 meshes with a ratchet-button 60 and a cog wheel 50 which are cooperatively connected to the sliding tab 30 allowing the medial portion 16 of the glove to be further adjusted to create a taut glove fit on the user's hand.

The generally semi-oval bottom piece 20 includes a top surface 21, a central aperture 22, and a distal end 23 that is pulled and attached to the back surface of the glove 10. As previously mentioned bottom surface 25 is outfitted with hook and loop attachment means (not shown) and attaches to a corresponding hook and loop attachment means 17 on the surface of the glove. The bottom piece 20 includes four receptacles 26 and their use is described below.

A generally semi-oval top piece 40, corresponding to size and shape to the bottom piece 20, has an upper surface 41 comprising a generally circular raised rim 42 about a perimeter of a relatively large circular hole 43 in the middle area of the top piece 40. The lower surface 44 of the top piece 40 incorporates a pair of fin shaped wedges 45 and four insert lugs 46. The wedges 45 and lugs 46 are sized to fit into appropriate areas of the bottom piece 20 and the lugs 46 are biasly snap-fitted into the corresponding four receptacles 26 of the bottom piece 20 when the top and bottom pieces 40, 20 sandwich the slide tab 30 to form the flap 13.

However, prior to the top and bottom pieces 40, 20, being connected together, the slide tab 30 is placed between them. The longitudinally shaped slide tab 30 is then sandwiched between the pieces 40, 20. One end 33 of the tab 30 is attached to the back surface on the medial side 16 of the glove, preferably by a row of marginal stitching along the access opening 14 which abuts the edge of the medial side 16. A lower side 31 of the slide tab 30 has a longitudinal cutout 36, wherein the inner perimeter of the cutout contains a series of notches 37. A longitudinal channel 32 is defined in the middle portion of the slide tab 30.

The cog wheel 50 is seated into the central aperture 22 of the bottom piece, and has an outer perimeter 50 containing gear teeth 51. A cylindrical rod 53 extends upwardly from an upper surface 52 of the cog wheel and extends through the channel 32 of the slide tab 30. Upon the slide tab 30 being positioned over the bottom piece 20 and the cog wheel 50 subsequently nested into the cutout 36 such that there is created a meshing between notches 37 of the slide tab 30 and the gear teeth 51 of the cog wheel 50. With these two parts meshing together, the cylindrical rod 53 extending through the channel 32 allows for guidance of the slide tab 30 as it moves in and out.

The final construction phase of the flap 13 is when the top piece 40 is secured to the bottom piece 20 by the biasly pushing of the lugs 46 of top piece 40 into the receptacles 26 of the bottom piece 20. When the flap 13 is complete the fins 45 of the top piece 40 are snugly positioned into corresponding sections of the bottom piece 20.

The final step towards completion of the closure flap 13 is the connecting of the ratchet-button 60 onto the cylindrical rod 53 of the cog member 50 that extends through the channel of the slide tab 30. The ratchet-button 60 has a top surface 61 for placement of a logo and a circular outer perimeter forming a gripping edge 62. The bottom surface 63 of the button has an opening 64 that is of a size and shape to fit securely about the rim 52 yet still allowing the button 60 to be turned about and rotated. A raised cylindrical opening 65 connects to the cylindrical rod 53 of the cog to secure the button. When the button 60 is turned by the user it will cause the slide tab 30 to be either drawn in or released to either tighten or loosen the glove fit.

When the tab 30 of closure flap 13 is attached to the back surface of the glove on the lateral side 15 the flap may be pulled over the opening 14 and fastened to the back surface of the glove by hook and loop fastening means 17.

Since the flap is preferably made from leather, it has minimal expansion or contraction, therefore the user is able to fully engage the flap in a taut relationship with the lateral portion of the glove. Most sport gloves depend upon the flap being able to stretch or expand to ensure a snug fit because the user usually must control the fit with one hand. With the present invention the hand locking is done by turning the button and moving it along the slide tab. This facilitates the convenience to the wearer, by allowing the glove to be easily put on, tightened, loosened, or removed, as necessary. This is especially convenient because it allows the wearer to quickly customize the fit of the glove throughout play. For example, if, initially, a glove is fitting properly, during play it might loosen because the leather stretches, or the wearer might decide they would like the glove looser or tighter. With a traditional glove, the wearer would be required to go through the tightening process from the beginning with all of the difficulties that can entail. Using the inventive system, the wearer can merely turn the button and move it in either direction to tighten or loosen it a notch or two.

It is to be understood that while certain forms of the present invention have been illustrated and described herein, it is not to be limited to the specific forms or arrangement of parts described and shown. An example may be where push button closure system utilizes some other shaped item to press and release the locking mechanism, or alternatively where a closure assembly other than leather is used as a flap. This invention is also not to be limited to the specifically preferred embodiments depicted therein.

We claim:

1. A glove closure system comprising:

a glove having fingers, thumb and an access opening defined on a back surface wherein a lateral side is separated from a medial side by an access opening;

a closure flap having means to tighten the glove by pulling the medial side to the lateral side and means for securing the flap to the back surface of the glove;

the closure flap comprising:

a bottom piece, a top piece and a slide tab that is sandwiched between them and connected by snap-fitting means; and a ratchet-button integral with the flap and having means for connection to the slide tab, wherein the slide tab is caused to move to either a further closed position or a loosened position by rotation of the ratchet-button either clockwise or counter-clockwise.

2. The closure flap of claim 1, wherein the snap-fitting means comprises the bottom piece having a plurality of receptacles and the top piece having a corresponding plurality of lugs that snap-fit into the receptacles with the slide tab sandwiched in-between.

3. The closure flap of claim 1, wherein one end of the slide tab is attached to the medial side along the edge of the access opening by a row of marginal stitching.

4. The closure flap of claim 1, wherein the ratchet-button connection means to the slide tab comprises:

a cog wheel having gear teeth about the wheel perimeter;

the slide tab having a longitudinal cutout on the bottom side and having a series of notches, the cutout of a size to mesh with the teeth of the cog wheel;

the slide bar having a longitudinal channel defined in the central section of a size allowing travel there through of a cylindrical rod extending upwards from the top surface of the cog wheel, the rod having a distal end connecting to the bottom surface of the ratchet-button to complete the construction of the flap closure.

5. The closure flap of claim 1, wherein the securing means comprises the lower surface of the lower piece having a hook and loop surface placed thereon and a complimentary hook and loop surface on the back surface that allows the user to secure the glove by pulling the flap to a taut fitness.

6. The glove closure system of claim 1, wherein the flap is generally rectangular or oval in shape.

7. The glove closure system of claim 1, wherein the flap is made of leather.

8. The glove closure system of claim 1, wherein the ratchet-button is made of an ABS plastic.

9. The glove closure system of claim 1, wherein the slide bar is made of a soft EPA material.

* * * * *